US008595970B2

(12) United States Patent
Picciotta et al.

(10) Patent No.: US 8,595,970 B2
(45) Date of Patent: Dec. 3, 2013

(54) ACCESSORY MOUNTING HAND GUARD FOR FIREARM

(75) Inventors: Michael D. Picciotta, Yorba Linda, CA (US); Lance Graham, Oceanside, CA (US); George Syrengelas, Garden Grove, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/451,755

(22) Filed: Apr. 20, 2012

(65) Prior Publication Data

US 2013/0276344 A1 Oct. 24, 2013

(51) Int. Cl.
*F41C 23/16* (2006.01)

(52) U.S. Cl.
USPC ..... 42/72; 29/525.01; 42/71.01; 42/111; 89/191.01

(58) Field of Classification Search
USPC ..... 42/14, 72, 94, 90, 84, 111, 146, 148, 42/71.01; 89/1.4, 125, 193, 191.01; 29/428, 525.01; 362/110
See application file for complete search history.

(56) References Cited

U.S. PATENT DOCUMENTS

| | | | | |
|---|---|---|---|---|
| 6,508,027 | B1 | 1/2003 | Kim | |
| 6,671,990 | B1 | 1/2004 | Booth | |
| 6,779,288 | B1 * | 8/2004 | Kim | 42/72 |
| 7,216,451 | B1 | 5/2007 | Troy | |
| 7,941,959 | B1 | 5/2011 | Swan | |
| 2011/0252625 | A1 * | 10/2011 | Daniel | 29/525.01 |

OTHER PUBLICATIONS

U.S. Appl. No. 29/441,983, filed Jan. 11, 2013, inventors: Wells et al., 11 pages.
U.S. Appl. No. 13/739,478, filed Jan. 11, 2013, inventors: Wells et al., 53 pages.

* cited by examiner

*Primary Examiner* — Stephen M Johnson
*Assistant Examiner* — John D Cooper
(74) *Attorney, Agent, or Firm* — Haynes and Boone, LLP

(57) ABSTRACT

An embodiment of a hand guard for a firearm, such as a rifle, includes an elongated tubular housing comprising an upper part, a lower part, opposite open ends, and a lumen configured to receive an intermediate portion of a barrel of a firearm longitudinally therein. An expansion collar is disposed at one end of the housing. The expansion collar has an expansion mechanism configured to adjustably compress the expansion collar and the lower part of the housing longitudinally between a pair of surfaces respectively disposed at opposite ends of the intermediate portion of the barrel.

27 Claims, 9 Drawing Sheets

ACCESSORY MOUNTING HAND GUARD FOR FIREARM

BACKGROUND

1. Technical Field

This invention relates to firearms in general, and in particular, to hand guards for firearms that permit various accessories to be mounted thereon.

2. Related Art

Firearms, such as the M16 and M4 rifles adopted for use by the U.S. military services, typically incorporate a hand guard made of a plastic or composite material, by which the shooter can effectively grasp a forward portion of the barrel of the weapon, e.g., for carrying, aiming and shooting the weapon effectively. Additionally, it is recognized that such firearms can often benefit from a variety of shooting accessories coupled to the weapon, such as lights for illuminating targets or sighting devices, e.g., laser targeting devices. Responsively, the prior art is replete with examples of devices, including hand guards adapted to replace the stock hand guard provided on the rifle, that are designed to enable one or more accessories to be coupled to the weapon.

However, these prior art devices and hand guards are not free of problems. For example, some rely on complicated mechanisms for coupling the hand guards to the rifle that can result in an unreliable mounting of the hand guard on the rifle, typically accompanied by a lengthy amount of time needed to mount the hand guard on the weapon. In other instances in which the hand guard mounts on the barrel of the rifle, the forces applied to the barrel in mounting the hand guard to it can twist or deform the barrel such that the accuracy of the rifle is adversely affected.

Accordingly, a need exists for hand guard designs that enable a variety of useful accessories to be mounted on a firearm, together with methods for mounting the hand guards on the firearm quickly, reliably and without adversely affecting their accuracy.

SUMMARY

In accordance with various embodiments described herein, hand guards that permit a variety of useful accessories to be mounted on firearms are provided, together with methods for mounting the hand guards on the firearms quickly, reliably and without adversely affecting their accuracy.

In one embodiment, a hand guard for a firearm, such as a rifle, includes an elongated tubular housing comprising an upper part, a lower part, opposite open ends, and a lumen configured to receive an intermediate portion of a barrel of a firearm longitudinally therein. An expansion collar is disposed at one end of the housing. The expansion collar has an expansion mechanism configured to adjustably compress the expansion collar and the lower part of the housing longitudinally between a pair of surfaces respectively disposed at opposite ends of the intermediate portion of the barrel.

In another embodiment, a method for using a hand guard with a firearm comprises providing an elongated tubular housing comprising an upper part, a lower part, opposite open ends, and a lumen configured to receive an intermediate portion of a barrel of the firearm longitudinally therein. An expansion collar is also provided. The collar has a longitudinally extending tongue and an expansion mechanism configured to adjustably compress the expansion collar and the lower part of the housing longitudinally between a pair of surfaces respectively disposed at opposite ends of the intermediate portion of the barrel. The tongue of the collar is inserted into an end of the housing to form an assembly, and the assembly is mounted onto a lower surface of the intermediate portion of the barrel and between the surfaces thereon. The expansion mechanism of the collar is then adjusted such that the assembly is held in compression between the surfaces.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the invention and their advantages are best understood by referring to the detailed description that follows. It should be appreciated that like reference numerals are used to identify like elements illustrated in one or more of the figures.

DETAILED DESCRIPTION

Figure 1A:
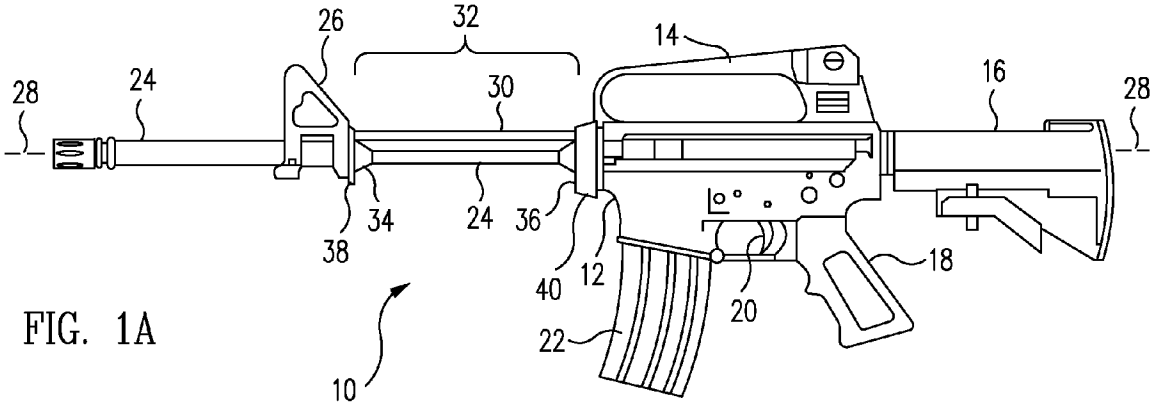
FIG. 1A is left side elevation view of an example firearm, namely, an M-16 rifle, of a type to which various hand guards of the present disclosure may be advantageously applied, in which a conventional hand guard has been omitted to reveal a gas tube and an intermediate portion of a barrel thereof, in accordance with an embodiment of the disclosure.

FIG. 1A is left side elevation view of an example firearm, namely, an M-16 rifle 10, of a type with which embodiments of the novel hand guard of the present disclosure can be advantageously utilized. The M16, and a variant thereof, viz., the M4, has generally replaced the M14 and M1 carbine as the standard infantry rifles of the U.S. armed forces. Currently, the M16 is the most commonly manufactured 5.56×45 mm rifle in the world, and is in use by 15 NATO countries and more than 80 countries worldwide. Numerous companies in the United States, Canada, and China have, together, produced more than 8,000,000 M-16 rifles, in all of its many variants, of which approximately 90% are still in operation.

As can be seen in FIG. 1A, the example rifle 10 includes a receiver 12 having a combined carrying handle and rear sight 14, a rear or shoulder stock 16 extending rearwardly from the receiver 12, a pistol-type hand grip 18, a trigger 20 for firing the rifle 10, a magazine 22 for holding ammunition, an elongated barrel 24 extending forwardly from the receiver 12, an upstanding front sight 26 mounted forwardly on the barrel 24, and a longitudinal axis 28 concentric with the barrel 24. Extending rearwardly from the front sight 26 to the receiver 12 is a gas tube 30 that conveys combustion gases from a port (not seen in FIG. 1A) in the barrel 24 located below the front sight 26 to the receiver 12, which are used by components in the receiver for the automatic actuation of the rifle 10 when it is fired.

The example rifle 10 also conventionally includes a hand guard, typically made of a plastic composite, that surrounds the gas tube 30 and an intermediate portion 32 of the barrel 24. However, in FIG. 1A, the conventional hand guard has been omitted for purposes of explication. As illustrated in FIG. 1A, the intermediate portion 32 of the barrel 24 includes a pair of front and rear radial surfaces 34 and 36 respectively disposed at opposite ends thereof. The front radial surface 34 comprises the rear surface of a hand guard forward support cap 38, and the rear radial surface 36 comprises the front surface of a threaded hand guard rear slip ring retainer 40 (also referred to as a barrel nut). As discussed in more detail below, the two radial surfaces 34 and 36 disposed at the opposite ends of the intermediate portion 32 of the barrel 24 can, in some embodiments, provide features that are advantageous for mounting a hand guard 100 in accordance with the present disclosure on the rifle 10.

Figure 1B:
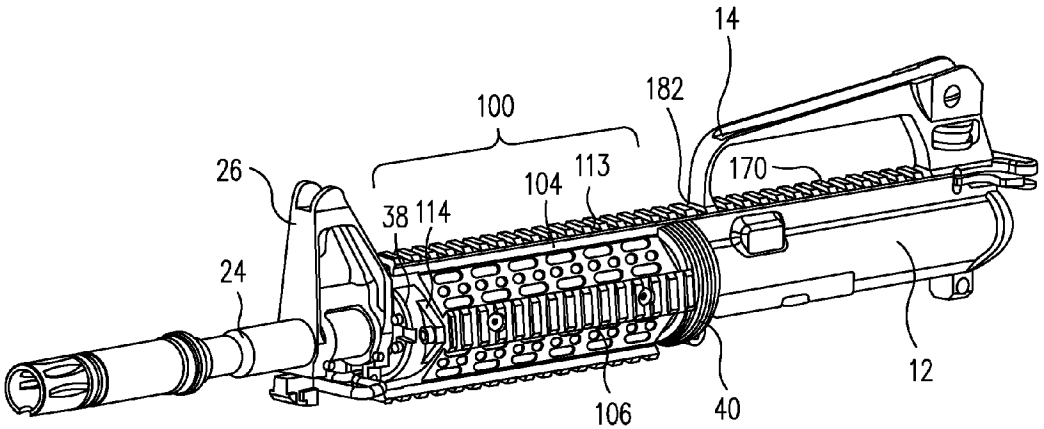
FIG. 1B is an upper, front, left side perspective view of the receiver and barrel of the rifle of FIG. 1A, showing an example embodiment of a hand guard in accordance with the present disclosure mounted thereon.
Figure 2:
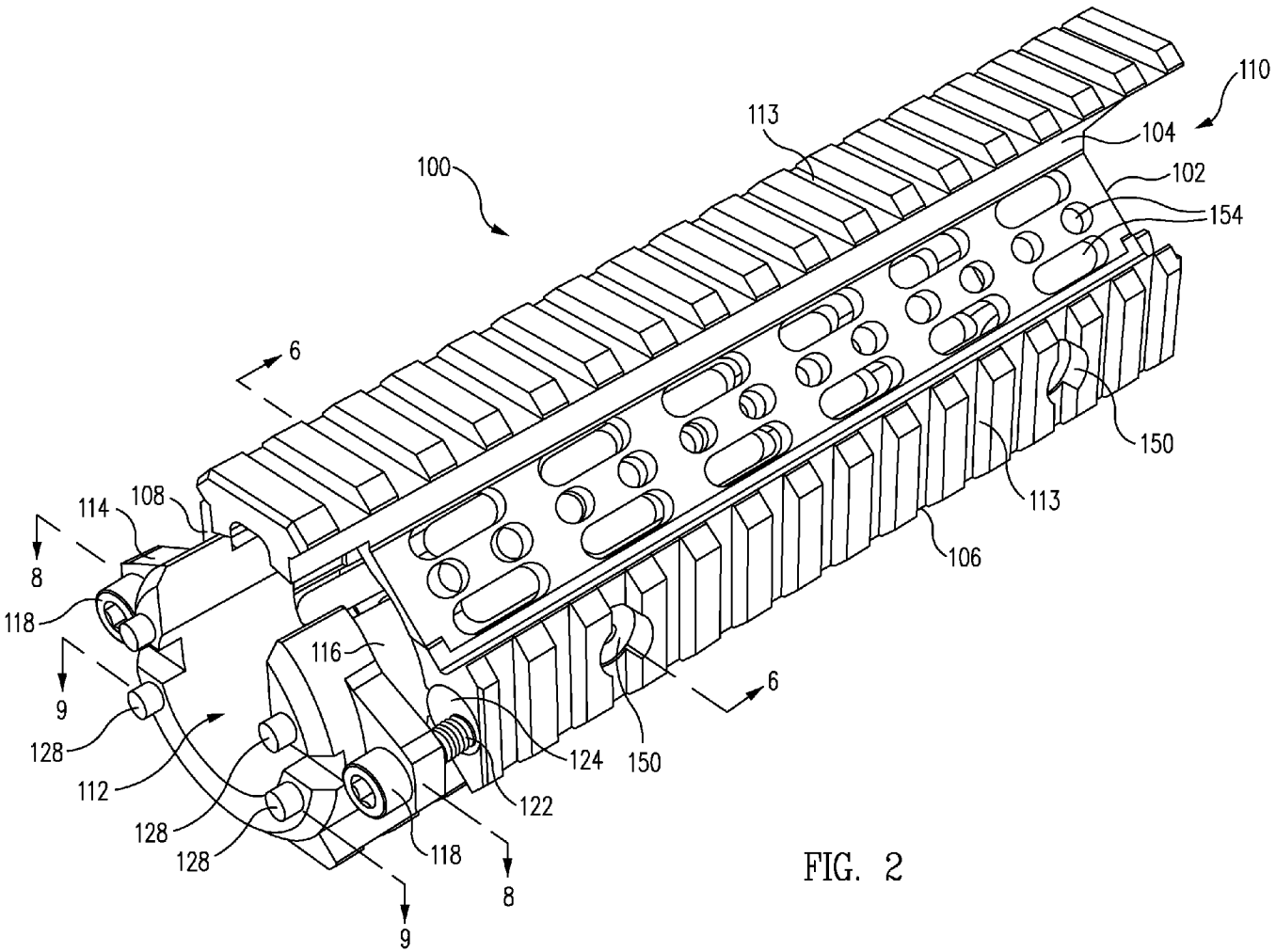
FIG. 2 is an upper, front, left side perspective view of the example hand guard of FIG. 1B.
Figure 3:
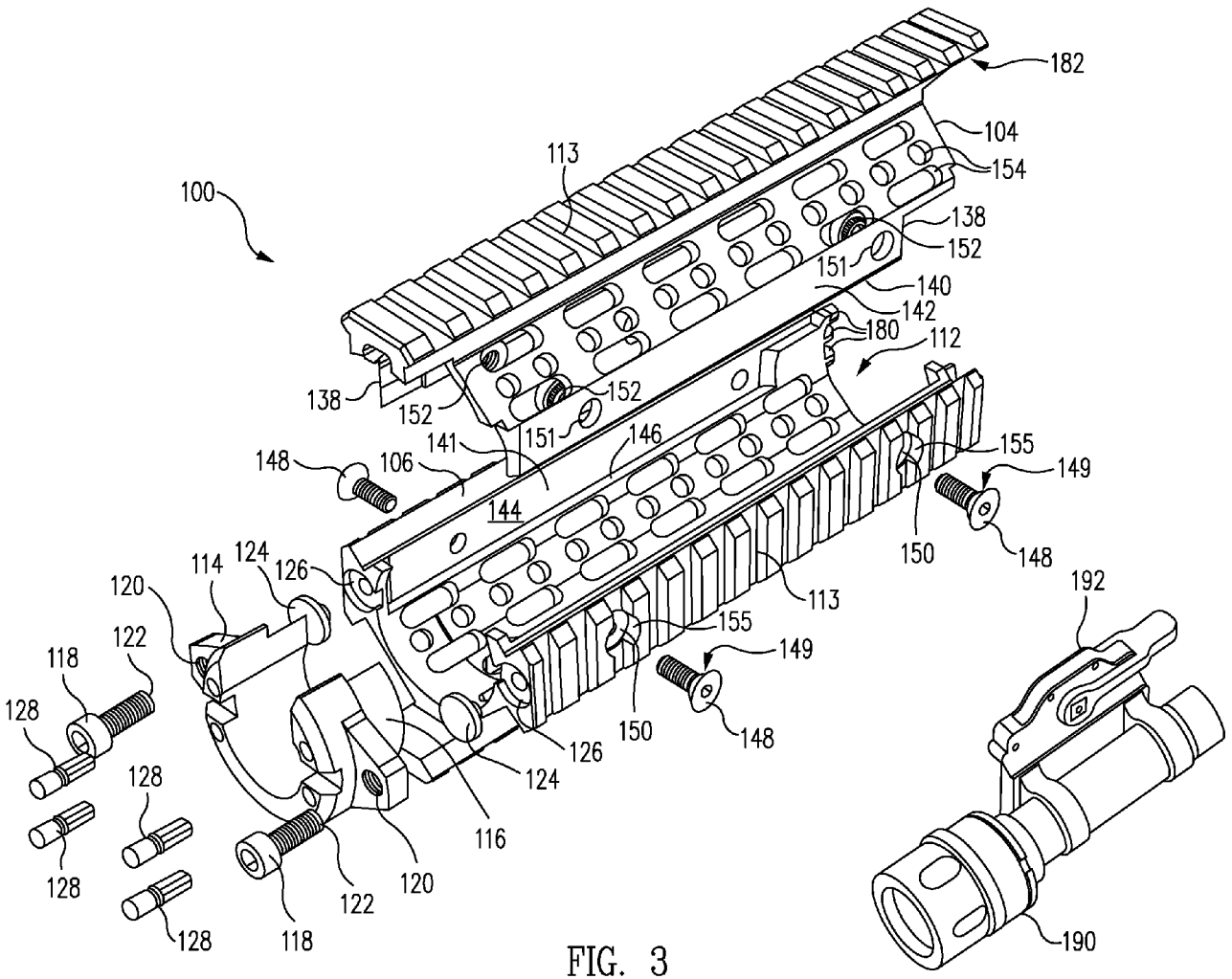
FIG. 3 is an upper, front, left side exploded perspective view of the example hand guard, showing an upper part, a lower part, and an expansion collar thereof.
Figure 4A:
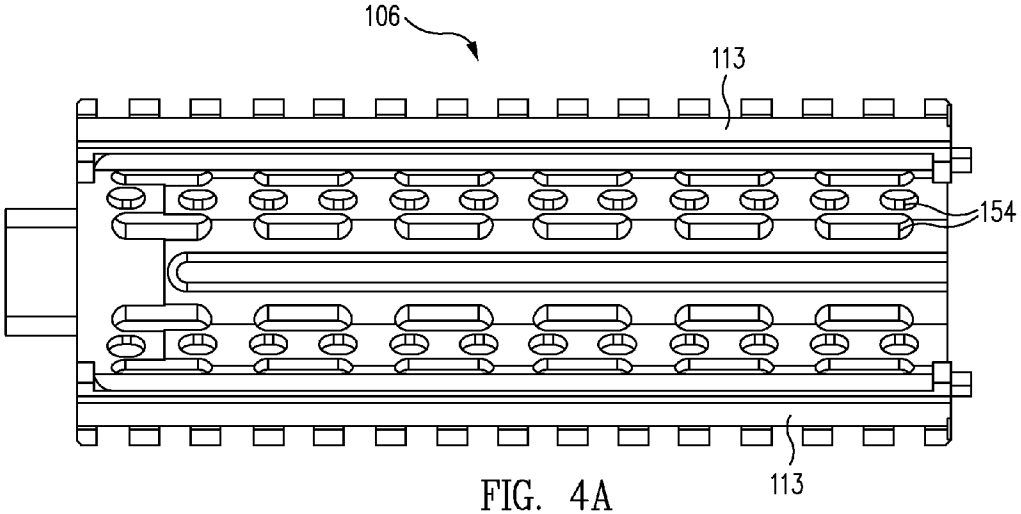
FIG. 4A is top plan view of the lower part of the example hand guard.
Figure 4B:
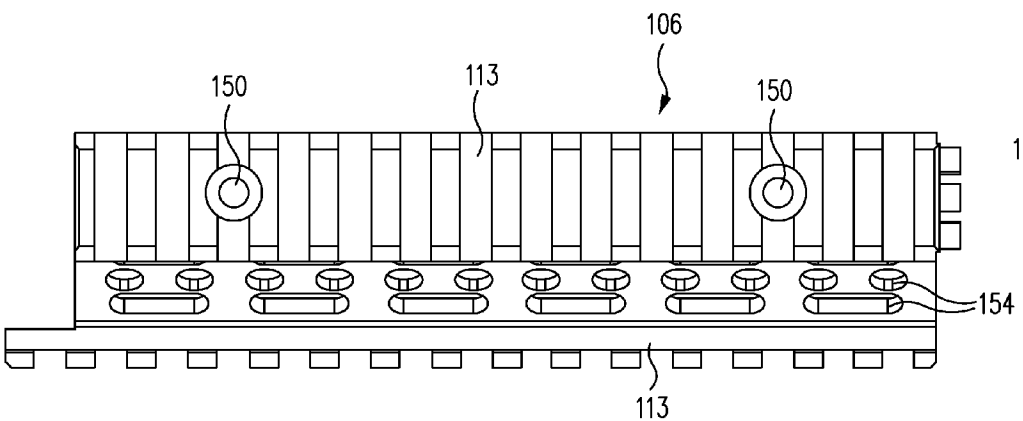
FIG. 4B is a left side elevation view of the lower part.
Figure 4C:
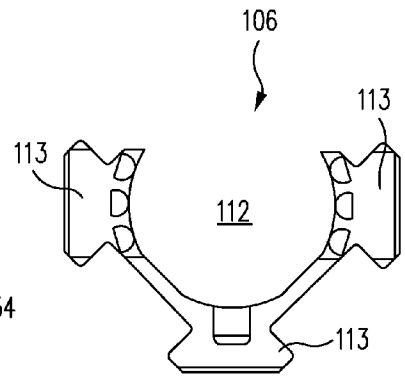
FIG. 4C is a rear end elevation view of the lower part.
Figure 4E:
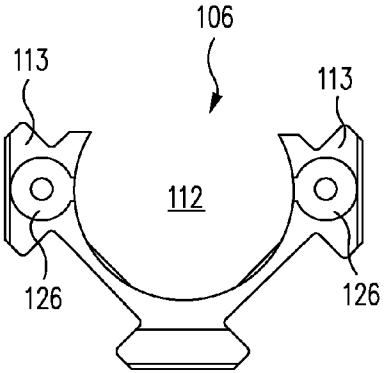
FIG. 4E is a front end elevation view of the lower part.
Figure 4D:
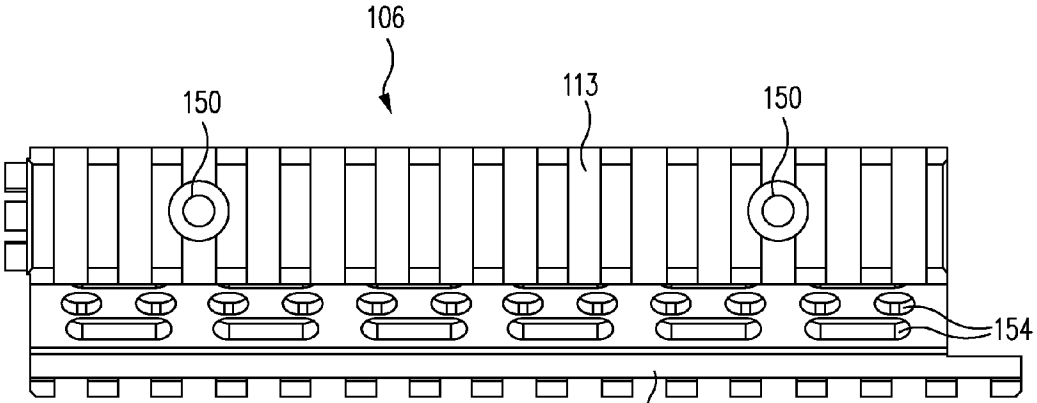
FIG. 4D is a right side elevation view of the lower part.
Figure 4F:
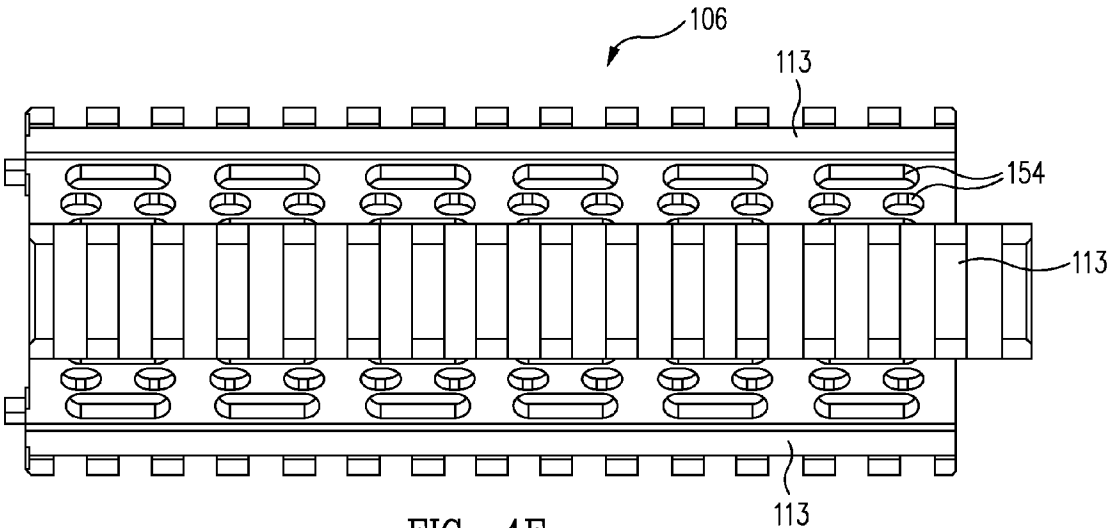
FIG. 4F is a bottom plan view of the lower part.

FIG. 1B is an upper, front, left side perspective view of the receiver 12 and barrel 24 of the rifle 10 of FIG. 1A, showing an example embodiment of a hand guard 100 in accordance with the present disclosure mounted thereon. FIGS. 2 and 3 are upper, front, left side perspective and exploded perspective views of the example hand guard 100, respectively. As illustrated in FIGS. 2 and 3, the example hand guard 100 comprises an elongated tubular housing 102 having an upper part 104, a lower part 106, opposite open ends 108 and 110, and a lumen 112 configured to receive the gas tube 30 and intermediate portion 32 of the barrel 24 of the firearm 10 longitudinally therein.

Figure 6:
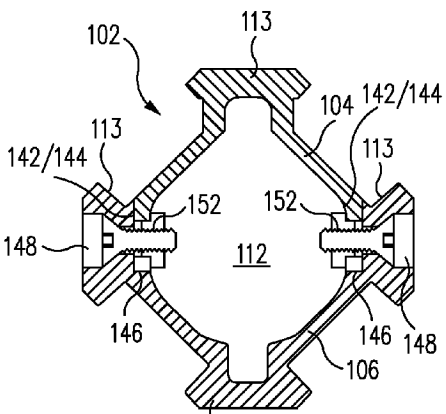
FIG. 6 is a cross-sectional view through the hand guard, as seen along the lines of the section 6-6 taken in FIG. 2.
Figure 5D:
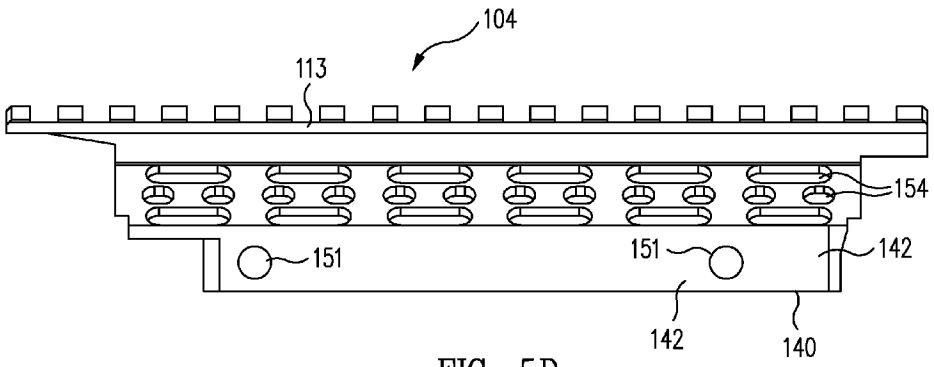
FIG. 5D is a right side elevation view of the upper part.
Figure 5F:
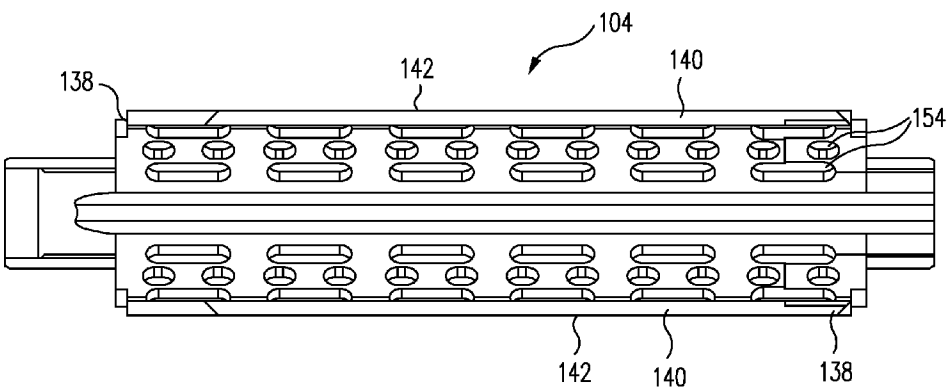
FIG. 5F is a lower plan view of the upper part.

As illustrated in the cross-sectional view of the housing 102 in FIG. 6, the housing 102 can have a generally polygonal cross-section, and in the particular embodiment illustrated, the housing 102 has eight side walls, i.e., is octagonal in cross-sectional shape. Other cross-sectional shapes, including round or annular, can also be used. At least one of the side walls of the housing 102 can comprise a longitudinal accessory mounting rail 113, such as specified in MIL-STD-1913 and commonly referred to as a "Picatinny" rail, or other type of rail. In the particular example embodiment illustrated in FIG. 6, four such accessory mounting rails 113 are provided, disposed in alternating fashion around the circumfery of the housing 102, one comprising the top side wall of the upper part 104 of the housing 102, and three comprising the two lateral and one bottom side walls of the lower part 106 thereof.

As shown in FIG. 1B, when hand guard 100 is installed on receiver 12, a top rail 113 on upper part 104 may be substantially level with another rail 170 (e.g., another longitudinal accessory mounting rail such as another Picatinny rail or other type of rail). Such positioning of rails 113 and 170 may advantageously permit various accessories to be mounted substantially in line with each other on rails 113 and 170 and/or permit such accessories to be mounted across both rails 113 and 170 (e.g., using mounting locations of both rails 113 and 170).

One or more accessories many be mounted on rails 113 such as, for example, lighting devices, sighting devices, and/or others. For example, as identified in FIG. 3, a lighting device 190 (e.g., a SureFire Scout Light in one embodiment) may be provided to be mounted on rails 113 (e.g., directly and/or with a rail clamp 192, such as a SureFire M93 Swing-Lever WeaponLight Rail Clamp in one embodiment and/or as identified in U.S. Pat. No. 8,127,484 which is hereby incorporated by reference in its entirety).

In some embodiments, upper part 104 may include one or more protrusions 182 (e.g., one or more flanges or individual protruding members) configured to engage or contact receiver 12 (see FIGS. 1B and 3). For example, protrusion 182 may extend over, rest upon, and/or push against various external portions of retainer 40 and/or of rear sight 14. In some embodiments, lower part 106 may include one or more protrusions 180 (e.g., implemented as one or more flanges or individual protruding members) configured to engage or contact receiver 12 (see FIGS. 1B and 3). For example, protrusions 180 may rest upon and/or push against retainer 40. In various embodiments, protrusions 180 and/or flanged portion 182 may be used to further secure hand guard 100 to rifle 10.

As illustrated in FIGS. 2, 3, 8, and 9, the example hand guard 100 further comprises an expansion collar 114 disposed at one end of the housing 102. The expansion collar 114 incorporates an expansion mechanism, described below, configured to adjustably compress the expansion collar 114 and the lower part 106 of the housing 102 longitudinally between the radial surfaces 34 and 36 located at opposite ends of the intermediate portion 32 of the barrel 24, as described above. In the particular embodiment illustrated in the figures, the expansion collar 114 is shown disposed adjacent to the front end 108 of the housing 102, but as those of some skill in the art will appreciate, this arrangement can be reversed, such that the expansion collar 114 is disposed adjacent to the rear end 110 of the housing 102.

Additionally, as illustrated in, e.g., FIGS. 2, 3, 7A, 7C, and 7D, the expansion collar 114 can include a longitudinal tongue 116 that can be slid into a complementary recess in the adjacent open ends 108 or 110 of the housing 102 to generally align the collar 114 concentrically with the housing 102 and the lumen 112 thereof.

Figure 8:
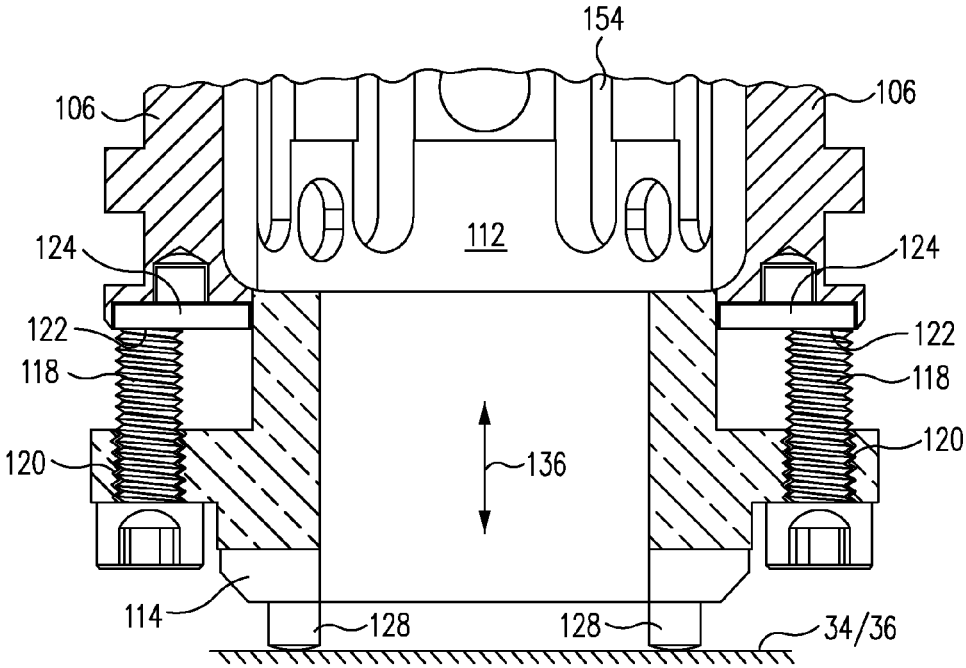
FIG. 8 is a partial cross-sectional view through the expansion collar, screws, and a front end of the example hand guard, as seen along the lines of the section 8-8 taken in FIG. 2; and, FIG. 9 is a partial cross-sectional view through the expansion collar, compression members, and a front end of the example hand guard, as seen along the lines of the section 9-9 taken in FIG. 2.

As illustrated in, e.g., FIGS. 2, 3 and 8, in one embodiment, the expansion mechanism can comprise a plurality, e.g., two or more, of longitudinally extending screws 118 (e.g., also referred to as jack screws) respectively received in corresponding ones of a plurality of threaded apertures 120 contained in the expansion collar 114. Each screw 118 has a distal end 122 that can be urged into abutment with an adjacent end, 108 or 110 of the lower part 106 of the housing 102. In some embodiments, the end 108 or 110 of the housing 102, against which the distal ends 122 of the screws 118 bear, can be protected against any resultant deformation and wear caused by abutment of the screw ends 122 by the provision of a corresponding plurality of wear pads 124 made of, e.g., a hard metal, disposed in corresponding, complementary recesses 126 in the adjacent end of the lower part 106 of the housing 102. The distal ends 112 of the screws 118 can then respectively bear on the pads 124 with virtually no resulting wear or deformation of the adjacent end of the lower part 106 of the housing. In addition, as screws 118 are tightened, the longitudinal expansion of hand guard 100 may cause protrusions 180 to push against retainer 40 and thus tighten end 110 of hand guard 100 against rifle 10.

Figure 7A:
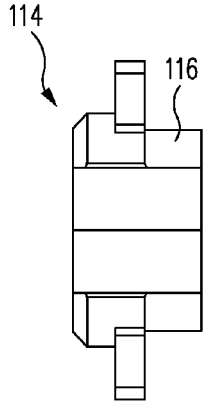
FIG. 7A is a top plan view of the expansion collar part of the example hand guard.
Figure 7B:
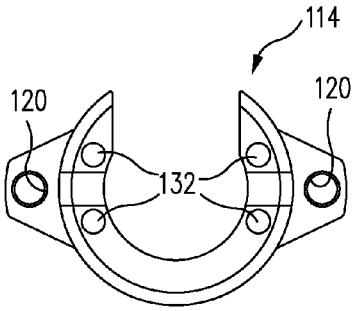
FIG. 7B is a front end elevation view of the expansion collar.
Figure 7C:
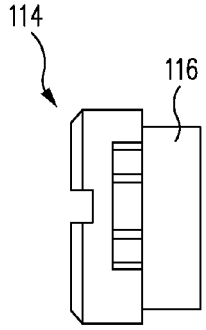
FIG. 7C is a left side elevation view of the expansion collar.
Figure 7D:
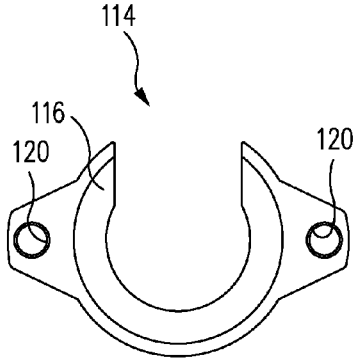
FIG. 7D is a rear end elevation view of the expansion collar.
Figure 7E:
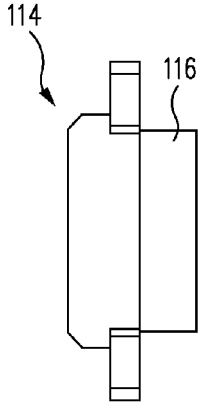
FIG. 7E is a bottom plan view of the expansion collar.
Figure 9:
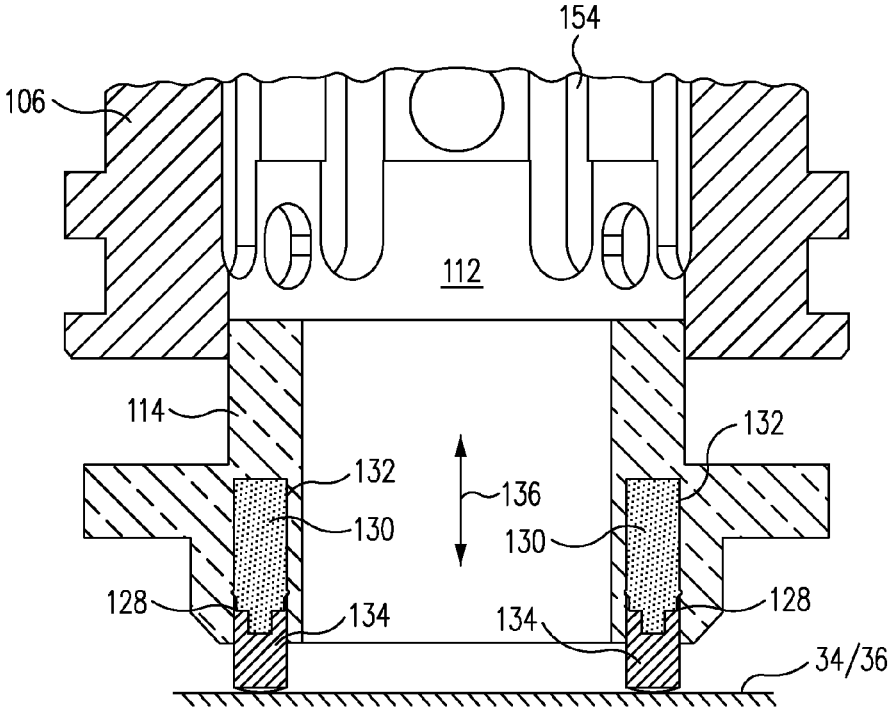

As illustrated in, e.g., FIGS. 3 and 9, in some embodiments, the expansion mechanism can further include a plurality of elongated compression members 128 that extend longitudinally from an end of the expansion collar 114 opposite to the end of the housing 102 at which the expansion collar 114 is disposed. As illustrated in FIG. 9, the compression members 128 can include a first end portion 130 that can comprise a material that may compress and expand (e.g., being at least partially deformable, compressible, and/or expandable) while still remaining relatively resilient, such as rubber or polyurethane, which is disposed in a corresponding bore 132 (see FIG. 7B) in the expansion collar 110, and an opposite second end 134 comprising a relatively harder bearing material, e.g., a metal, such as steel.

In some embodiments, the example hand guard 100 can be mounted on an associated rifle 10 in accordance with the following example mounting method, in which it is assumed that the expansion collar 114 is mounted at the front end 108 of the housing 102 and disposed adjacent to the front radial surface 34, as illustrated in the example embodiment of FIGS. 1A and 1B.

First, the upper part of the housing 102 is removed from the lower part 106, which can be effected in a manner described in more detail below. The longitudinal tongue 116 of the expansion collar 114 is inserted into the front end 108 of the lower part 106 of the housing 102 to form a loose assembly therewith. The assembly of the expansion collar 114 and lower part 106 of the housing 102 is then mounted onto the lower surface of the intermediate portion 32 of the rifle barrel 24 and between the radial surfaces 34 and 36 disposed at the opposite ends thereof, i.e., with the compression members 128 of the expansion collar 114 disposed adjacent to the front radial surface 34 and the rear end 110 of the lower part 106 of the housing 102 disposed adjacent to the rear radial surface 36. In one embodiment, the assembly of the expansion collar 114 and lower part 106 of the housing may be positioned around (e.g., without touching) the intermediate portion 32 of the rifle barrel 24 and rotated thereabout until the lower part 106 of the housing 102 is disposed beneath the rifle barrel 24.

As illustrated in FIG. 8, the screws 118 are then advanced in their respective threaded apertures 120 in the expansion collar 114 such that the distal end 122 of each screw 118 engages a corresponding pad 124 in the adjacent end of the lower part 106 of the housing 102. As indicated by the arrows 136 in FIGS. 8 and 9, further advancement of the screws 118 causes the lower part 102 and expansion collar 114 to spread apart from each other, thereby loading the entire longitudinal assembly comprising the compression members 128, the expansion collar 114, and the lower part 106 of the housing 102, in compression between the two radial surfaces 34 and 36, thereby firmly coupling the longitudinal assembly firmly to the rifle 10.

As those of some skill will appreciate, this compressive force results in a reactive longitudinal tensile force being applied to the barrel 24 of the rifle 10, which, unlike various prior hand guards, does not result in any twisting or local deformations of the barrel 24, and therefore does not adversely affect the accuracy of the rifle 10. Any differences in the respective forces exerted by the screws 118 are taken up by the plurality of compression members 128, which compress or expand locally (e.g., performed by the material of first end portion 130) to ensure that the force exerted by the screws 118 is substantially uniformly distributed among the compression members and on the adjacent end of the bottom part 106 of the housing 102. Although such compression and expansion is described as being performed by the material of first end portion 130 of compression members 128, such material may be provided by any component of hand guard 100. For example, in one embodiment, such material may be provided as part of screws 118 and/or other components adapted to compress and expand between end 108 and surface 34.

One of the many advantages provided by embodiments of the hand guard 100 of the present disclosure is that the upper part 104 of the housing 102 can be removed from the lower part 106 of the housing 102, e.g., to gain access to the gas tube 30 and/or the intermediate portion 32 of the barrel 24, without having to remove the lower part 106 and expansion collar 114 from the rifle 10. As illustrated in, e.g., FIGS. 3 and 6, this can be effected by the provision of a coupling mechanism for releasably coupling the upper part 104 of the housing 102 to the lower part 106 thereof. Moreover, the lower part 106 may remain tightly engaged with surfaces 34 and 36 (e.g., by longitudinal expansion) while the upper part 104 is removed. As a result, accessories installed onto lower part 106 may remain attached and in alignment while the upper part 104 is removed. Also, accessories installed onto upper part 104 may also remain attached and in alignment while the upper part 104 is removed. Therefore, if upper part 104 is subsequently attached to lower part 106, all accessories attached to hand guard 100 may be aligned and ready for use without requiring further adjustment by the user.

In other embodiments, the locations and/or configurations of upper part 104 and/or lower part 106 may be changed. For example, in one embodiment, the locations of upper part 104 and lower part 106 may be reversed such that upper part 104 is actually positioned below lower part 106 while hand guard 100 is installed on intermediate portion 32 of barrel 24. In such an embodiment, upper part 104 may be lowered downward from rifle 10 (e.g., lowered down on the trigger side of rifle 10) while lower part 106 remains installed (e.g., positioned on a top side of rifle 10 and straddling intermediate portion 32 of barrel 24).

Figure 5A:
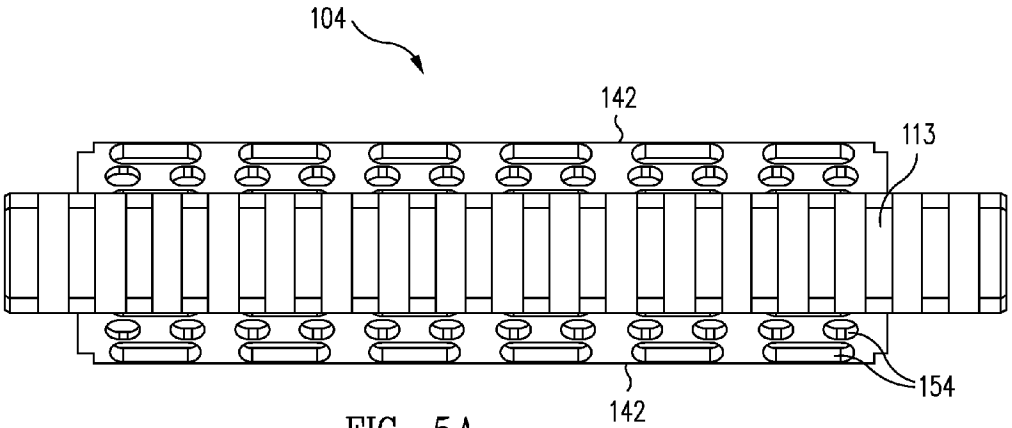
FIG. 5A is a top plan view of the upper part of the example hand guard.
Figure 5B:
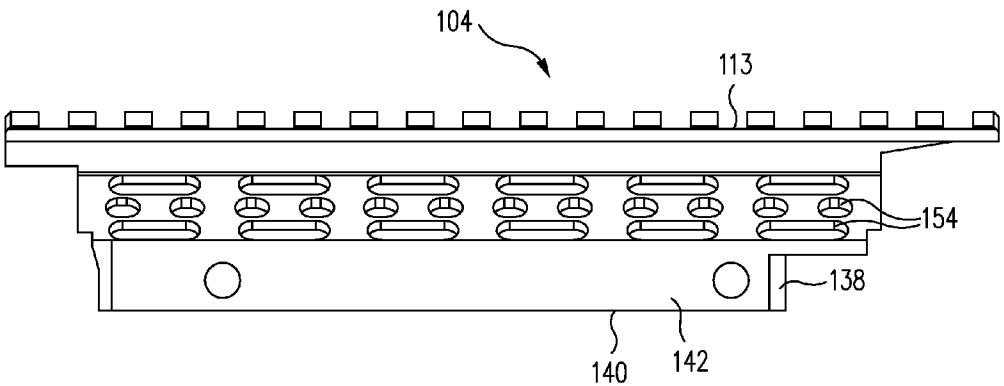
FIG. 5B is a left side elevation view of the upper part.
Figure 5C:
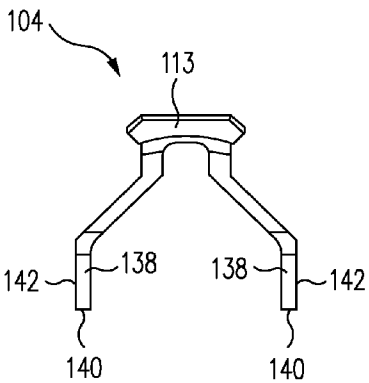
FIG. 5C is a rear end elevation view of the upper part.
Figure 5E:
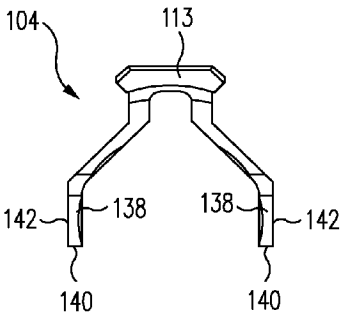
FIG. 5E is a front end elevation view of the upper part.

As illustrated in, e.g., FIGS. 3, 5C, and 5E, the upper part 104 of the housing 102 can include a pair of laterally spaced, downwardly extending side walls 138, each having a lower edge 140 and a generally planar exterior surface 142. As illustrated in, e.g., FIGS. 3 and 6, the lower part 106 of the housing 102 can have a pair of laterally spaced, upwardly extending side walls 141, each of which has a generally planar interior surface 144, with a ledge 146 disposed at a lower edge thereof. As illustrated in FIG. 6, the side walls 138 of the upper part 104 are positionable inside the side walls 141 of the lower part 106 such that respective ones of the planar exterior surfaces 142 of the side walls 138 of the upper part 104 are disposed in facing opposition to corresponding ones of the planar interior surfaces 144 of the side walls 141 of the lower part 102. As illustrated in, e.g., FIGS. 3, 4B, 4D and 6, the coupling mechanism can comprise a plurality of threaded fasteners 148 respectively extending laterally through apertures 150 (e.g., openings) in corresponding ones of the side walls 141 of the lower part 106 of the housing 102 and into corresponding threaded apertures 152 disposed in corresponding ones of the side walls 138 of the upper part 104 of the housing 102, and arranged such that advancement of the fasteners 148 into the threaded apertures 152 acts to pull the planar surfaces 142 of the side walls 138 of the upper part 104 into engagement with corresponding ones of the planar surfaces 144 of the side walls 141 of the lower part 106. In one embodiment, threaded apertures 152 may be provided by side walls 138 of the upper part 104 (e.g., integral therewith). In another embodiment, threaded apertures 152 may be provided by separate components 153 (e.g., nuts or bushings) that are pressed, welded, and/or otherwise attached positioned into apertures 151 of the upper part 104 (e.g., positioned within lumen 112 when hand guard 100 is assembled).

Additionally, in some embodiments, the threaded apertures 152 in the side walls 138 of the upper part 104 can be respectively disposed a first distance above the lower edge 140 of the corresponding side wall 138 of the upper part 104, and the apertures 150 in the side walls 141 of the lower part 106 can be respectively disposed a second distance above the ledge 146 of the corresponding side wall 141. The first distance can be made slightly greater than the second distance (e.g., greater by a distance of approximately 8 thousandths of an inch in one embodiment), such that advancement of the threaded fasteners 148 into the threaded apertures 152 further acts to pull the lower edges 140 of the side walls 138 of the upper part 104 into a tight engagement with the corresponding ledges 146 of the side walls 141 of the lower part 106, thus ensuring a tight coupling of the upper part 104 to the lower part 106.

In some embodiments, as shown in FIG. 3, apertures 150 may be implemented with countersinks 155. In one embodiment, countersinks 155 may be offset downward or otherwise (e.g., by approximately 8 thousandths of an inch in one embodiment) such that upper portions of heads 149 of threaded fasteners 148 contact rail 113 and/or the lower part 106 before threaded fasteners 148 are fully screwed into threaded apertures 152 and fully seated within countersinks 155. Such contact can provide compressive force to further secure upper part 104 and lower part 106 together.

As illustrated in, e.g., FIGS. 2 and 3, selected ones or all of the side walls of the housing 102 can include a pattern of vent holes 154 extending therethrough. The vent holes 154 serve to reduce the weight of the hand guard substantially, and can also serve both to cool the barrel 24 of the rifle 10 during extended firing thereof, thereby ensuring that the hand guard 100 remains cool to the touch, and also to mount certain types of accessories to the hand guard 100 (e.g., such as lighting device 190 in one embodiment). In various embodiments, accessories may be mounted directly to vent holes 154 (e.g., without requiring rail clamp 192 or other mounting mechanisms).

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A hand guard, comprising:

an elongated tubular housing comprising an upper part, a lower part, opposite open ends, and a lumen configured to receive an intermediate portion of a barrel of a firearm longitudinally therein;

an expansion collar disposed at one end of the housing and comprising an expansion mechanism configured to adjustably compress the expansion collar and the lower part of the housing longitudinally between a pair of surfaces respectively disposed at opposite ends of the intermediate portion of the barrel; and wherein the expansion mechanism comprises a plurality of longitudinally extending screws respectively received in corresponding ones of a plurality of threaded apertures contained in the expansion collar, each screw comprising a distal end disposed in abutment with an adjacent end of the lower part of the housing.

2. The hand guard of claim 1, wherein the distal ends of the screws are respectively disposed in abutment with corresponding ones of a plurality of pads disposed in the adjacent end of the lower part of the housing.

3. The hand guard of claim 1, wherein the expansion mechanism further comprises a plurality of elongated compression members extending longitudinally from an end of the expansion collar opposite to the adjacent end of the lower part of the housing.

4. The hand guard of claim 1, further comprising a material positioned between the one end of the housing and at least one of the surfaces, wherein the material is adapted to compress and expand to distribute substantially longitudinal forces over the at least one of the surfaces.

5. The hand guard of claim 1, wherein the housing has a generally polygonal cross-section.

6. The hand guard of claim 1, wherein the housing has a generally octagonal cross-section.

7. The hand guard of claim 1, further comprising a coupling mechanism for releasably coupling the upper part of the housing to the lower part of the housing.

8. The hand guard of claim 7, wherein the upper part comprises a protrusion adapted to extend over at least a portion of a receiver of the firearm while the upper part of the housing is coupled to the lower part of the housing.

9. The hand guard of claim 7, wherein:

the upper part of the housing has a pair of laterally spaced, downwardly extending side walls, each comprising a lower edge and a generally planar exterior surface;

the lower part of the housing has a pair of laterally spaced, upwardly extending side walls, each comprising a generally planar interior surface with a ledge disposed at a lower edge thereof;

the side walls of the upper part are positionable inside the side walls of the lower part such that respective ones of the planar exterior surfaces of the side walls of the upper part are disposed in facing opposition to corresponding ones of the planar interior surfaces of the side walls of the lower part; and the coupling mechanism comprises a plurality of threaded fasteners respectively extending laterally through openings in corresponding ones of the side walls of the lower part of the housing and into corresponding threaded apertures disposed in corresponding ones of the side walls of the upper part of the housing and arranged such that advancement of the fasteners into the threaded apertures acts to pull the planar surfaces of the side walls of the upper part into engagement with corresponding ones of the planar surfaces of the side walls of the lower part.

10. The hand guard of claim 9, wherein:

the threaded apertures in the side walls of the upper part are respectively disposed a first distance above the lower edge of the corresponding side wall of the upper part;

the openings in the side walls of the lower part are respectively disposed a second distance above the ledge of the corresponding side wall; and the first distance is greater than the second distance such that advancement of the fasteners into the threaded apertures further acts to pull the lower edges of the side walls of the upper part into engagement with the corresponding ledges of the side walls of the lower part.

11. The hand guard of claim 1, wherein a side wall of the housing comprises at least one longitudinal accessory mounting rail.

12. The hand guard of claim 11, wherein the longitudinal accessory mounting rail of the hand guard is adapted to be substantially level with a longitudinal accessory mounting rail provided on a receiver of the firearm when the hand guard is installed on the firearm.

13. The hand guard of claim 11, wherein the at least one accessory mounting rail comprises a Picatinny rail.

14. The hand guard of claim 11, further comprising an accessory mounted to the at least one accessory mounting rail.

15. The hand guard of claim 14, wherein the accessory comprises a light or a sighting device.

16. The hand guard of claim 11, wherein the side wall is provided by the upper part of the housing and is configured to be disposed substantially above the barrel to permit an accessory to be mounted substantially above the barrel on the at least one longitudinal accessory mounting rail.

17. The hand guard of claim 11, wherein the side wall is provided by the upper part of the housing and is configured to be disposed substantially below the barrel to permit an accessory to be mounted substantially below the barrel on the at least one longitudinal accessory mounting rail.

18. The hand guard of claim 1, wherein a side wall of the housing comprises a pattern of vent holes extending therethrough.

19. The hand guard of claim 18, further comprising an accessory mounted to the housing the vent holes.

20. A method for using a hand guard with a firearm, the method comprising:

providing an elongated tubular housing comprising an upper part, a lower part, opposite open ends, and a lumen configured to receive an intermediate portion of a barrel of the firearm longitudinally therein;

providing an expansion collar comprising a longitudinally extending tongue and an expansion mechanism configured to adjustably compress the expansion collar and the lower part of the housing longitudinally between a pair of surfaces respectively disposed at opposite ends of the intermediate portion of the barrel;

inserting the tongue of the collar into one of the ends of the housing to form an assembly;

positioning the assembly around the intermediate portion of the barrel and between the surfaces;

adjusting the expansion mechanism of the collar such that the assembly is held in compression between the surfaces; and wherein the adjusting comprises advancing a plurality of longitudinally extending screws respectively received in corresponding ones of a plurality of threaded apertures contained in the expansion collar such that a distal end of each screw is disposed in abutment with an adjacent end of the lower part of the housing and at least a portion of each screw is loaded in compression.

21. The method of claim 20, further comprising:

distributing substantially longitudinal forces over at least one of the surfaces by compression and expansion of a material positioned between the end of the housing and at least one of the surfaces disposed at one of the ends of the intermediate portion of the barrel.

22. The method of claim 20, further comprising coupling the upper part of the housing to the lower part of the housing.

23. The method of claim 22, wherein the upper part comprises a protrusion adapted to extend over at least a portion of a receiver of the firearm while the upper part of the housing is coupled to the lower part of the housing.

24. The method of claim 20, wherein at least one side wall of the housing comprises a longitudinal accessory mounting rail, and further comprising mounting an accessory to the at least one longitudinal accessory mounting rail.

25. The method of claim 24, wherein the longitudinal accessory mounting rail of the hand guard is adapted to be substantially level with a longitudinal accessory mounting rail provided on a receiver of the firearm when the hand guard is installed on the firearm.

26. The method of claim 24, wherein the side wall is provided by the upper part of the housing and is configured to be disposed substantially above the barrel to permit the mounting of the accessory substantially above the barrel on the at least one longitudinal accessory mounting rail.

27. The method of claim 24, wherein the side wall is provided by the upper part of the housing and is configured to be disposed substantially below the barrel to permit the mounting of the accessory substantially below the barrel on the at least one longitudinal accessory mounting rail.

* * * * *